US010052835B2

(12) United States Patent
Preen et al.

(10) Patent No.: US 10,052,835 B2
(45) Date of Patent: Aug. 21, 2018

(54) HOUSEHOLD WASTE RECYCLING MODULE AND APPLIANCE ASSEMBLY

(75) Inventors: Martin Preen, Bourne (GB); Iain Dulley, Bourne (GB)

(73) Assignee: Krushr Limited, Bourne (GB)

( * ) Notice: Subject to any disclaimer, the term of this patent is extended or adjusted under 35 U.S.C. 154(b) by 829 days.

(21) Appl. No.: 13/884,583

(22) PCT Filed: Nov. 7, 2011

(86) PCT No.: PCT/GB2011/052161
§ 371 (c)(1),
(2), (4) Date: May 9, 2013

(87) PCT Pub. No.: WO2012/063053
PCT Pub. Date: May 18, 2012

(65) Prior Publication Data

US 2013/0220149 A1 Aug. 29, 2013

(30) Foreign Application Priority Data

Nov. 9, 2010 (GB) ..... 1018919.9

(51) Int. Cl.
*B30B 9/32* (2006.01)
*B65F 1/14* (2006.01)
*B30B 9/30* (2006.01)

(52) U.S. Cl.
CPC ..... *B30B 9/321* (2013.01); *B30B 9/3003* (2013.01); *B30B 9/3032* (2013.01); *B65F 1/1405* (2013.01); *B65F 1/1436* (2013.01)

(58) Field of Classification Search
CPC ..... B30B 9/321; B30B 9/3003; B30B 9/3032; B30B 9/306; B65F 1/1405; B65F 1/1436; B02C 19/0081
USPC ..... 100/218, 240, 246, 251, 252, 902; 220/908, 909
See application file for complete search history.

(56) References Cited

U.S. PATENT DOCUMENTS 2,124,511 A * 7/1938 Schmitz ..... B42F 17/02 220/542
3,460,463 A * 8/1969 Jernstrom ..... B30B 1/18 100/126
3,714,890 A 2/1973 Moon
3,722,971 A 3/1973 Zeischegg
3,734,006 A 5/1973 Hennells
3,753,400 A 8/1973 Miller
3,765,148 A 10/1973 Ippolito et al.
(Continued)

FOREIGN PATENT DOCUMENTS

DE 2 008 519 2/1972
DE 2008519 2/1972
(Continued)

OTHER PUBLICATIONS

English translation of German Utility Model No. DE 89 00 054.
(Continued)

*Primary Examiner* — Jimmy T Nguyen
(74) *Attorney, Agent, or Firm* — DASCENZO Intellectual Property Law, P.C.

(57) ABSTRACT

A can crushing and storing module has a chassis, a crushing unit, and a storage unit. The crushing unit includes a drawer, which is slidable into and out of the chassis, and a can crushing device that is mounted in the drawer.

19 Claims, 8 Drawing Sheets

(56) References Cited

U.S. PATENT DOCUMENTS

| | | | | | |
|---|---|---|---|---|---|
| 3,768,398 | A | * | 10/1973 | Ullman, Jr. | B30B 9/3017 100/218 |
| 3,831,514 | A | * | 8/1974 | Jernstrom | B30B 9/3042 100/229 A |
| 3,834,776 | A | | 9/1974 | Becker, Jr. | |
| 3,851,578 | A | | 12/1974 | Engebretsen | |
| 3,995,543 | A | | 12/1976 | Montalbano | |
| 4,054,088 | A | | 10/1977 | Nee | |
| 4,064,798 | A | * | 12/1977 | Wolbrink | B30B 9/306 100/218 |
| 4,100,850 | A | | 7/1978 | Wolbrink et al. | |
| 4,213,386 | A | * | 7/1980 | Telling | B02C 1/00 100/209 |
| 4,269,114 | A | * | 5/1981 | Schwarz | B30B 1/003 100/229 A |
| 4,407,191 | A | * | 10/1983 | Brenner | B30B 9/3007 100/229 A |
| 4,518,142 | A | | 5/1985 | Sulcek et al. | |
| 4,548,132 | A | * | 10/1985 | Moon | B30B 1/006 100/229 A |
| 4,638,730 | A | | 1/1987 | Bonacorsi | |
| 5,001,977 | A | | 3/1991 | Tracy | |
| 5,002,346 | A | | 3/1991 | Gasser | |
| 5,364,181 | A | | 11/1994 | Scheible | |
| 5,417,154 | A | * | 5/1995 | Plaats | B30B 9/321 100/100 |
| 6,367,377 | B1 | | 4/2002 | Gawley et al. | |
| 6,923,114 | B2 | * | 8/2005 | Koch | B30B 9/3064 100/229 A |
| 7,536,948 | B1 | * | 5/2009 | Cockrum | B30B 1/261 100/215 |
| 2005/0061167 | A1 | | 3/2005 | Fox | |
| 2008/0041246 | A1 | | 2/2008 | Fox | |
| 2009/0314169 | A1 | | 12/2009 | Kachkovsky | |
| 2011/0056393 | A1 | | 3/2011 | Kachkovski | |

FOREIGN PATENT DOCUMENTS

| | | | |
|---|---|---|---|
| DE | 89 00 054 | | 5/1989 |
| DE | 8900054 | | 5/1989 |
| DE | 4313764 | | 11/1993 |
| DE | 296 20 192 | | 1/1997 |
| DE | 29620192 | | 1/1997 |
| EP | 0096898 | A1 | 12/1983 |
| EP | 1707345 | | 10/2006 |
| EP | 1 745 921 | | 1/2007 |
| EP | 1745921 | | 1/2007 |
| FR | 2062731 | | 6/1971 |
| FR | 2159109 | | 6/1973 |
| FR | 2246469 | A1 | 5/1975 |
| GB | 1 218 152 | | 1/1971 |
| GB | 1218152 | | 1/1971 |
| GB | 1257272 | | 12/1971 |
| GB | 1342466 | | 1/1974 |
| GB | 2447612 | | 9/2008 |
| GB | 2455232 | A | 6/2009 |
| JP | 2001259894 | | 9/2001 |
| WO | WO 02102580 | | 12/2002 |
| WO | WO 2008000510 | A2 | 1/2008 |
| WO | WO 2009073039 | | 6/2009 |
| WO | WO 2010034494 | | 4/2010 |

OTHER PUBLICATIONS

English translation of German Utility Model No. DE 296 20 192.
Machine-generated English translation of DE 2 008 519, downloaded from Espacenet.com, Mar. 3, 2016.
Machine-generated English-language translation of DE 2008519 obtained from Espacenet.com on May 8, 2013.
English-language abstract of DE 4313764 obtained from Espacenet.com on May 9, 2013.
English-language abstract of EP 0096898 A1 obtained from Espacenet.com on May 8, 2013.
Machine-generated English-language translation of FR 2246469 A1 obtained from Espacenet.com on May 8, 2013.
English-language abstract of JP 2001259894 obtained from European Patent Office.
English-language abstract of WO 02102580.

* cited by examiner

HOUSEHOLD WASTE RECYCLING MODULE AND APPLIANCE ASSEMBLY

BACKGROUND OF THE INVENTION

The invention relates to household waste crushing and storing. In particular, although not exclusively, the invention relates to a household appliance for crushing and storing metal food and drinks containers.

Pressure to recycle has led to many household waste collection services offering the facility to treat recyclable and non-recyclable waste differently. This generally requires households to separate recyclable waste from non-recyclable waste and even to sub-divide recyclable waste into different types. As a result, households need to be able to store all the different types of waste ready for collection. What is more, in order to store waste efficiently, it is preferable to crush or compact it first. Take, for example, metal drinks or food containers, such as cans; once emptied, they have a large volume to weight ratio, and it is much more efficient to store them in a crushed, reduced volume form. So, there is a requirement for a household appliance that can not only store recyclable waste but also crush it first.

Metal containers are hereinafter referred to as "cans."

BRIEF SUMMARY OF THE INVENTION

In a first aspect, the invention provides a can crushing and storing module comprising a crushing unit and a storing unit.

The can crushing and storing module may suitably comprise a chassis, enclosed on all sides apart from its front by a skin, e.g. of a plastics material. Aptly, the crushing unit and a storing unit are mounted, e.g. slidably mounted, in the chassis. In one embodiment, the two units are slidable in and out of the front of the chassis to and from the rear of the chassis in a generally horizontal direction of sliding. Often each of the two units is elongate from the front to the rear, and is slidable in and out of the front of the chassis to and from the rear of the chassis in a direction generally corresponding to its elongate dimension.

Aptly, the crushing unit comprises a drawer and a can crushing device, wherein the can crushing device is mounted in the drawer.

Aptly, the crushing device is mounted in the drawer and the drawer is so constructed (as described further hereinafter) that the drawer is able to withstand the forces in the crushing device during the crushing operation.

This avoids the type of set up used hitherto where a relatively weak feeder drawer is simply used to access a separate crushing device. This provides a distinct advantage over such set ups, as it reduces costs and reduces the risk of jams.

Aptly, the can crushing device used in the crushing unit comprises an elongate crushing compartment having at least two, for example a plurality of walls. Aptly, at least one of the walls is moveable during a crushing operation thereby to reduce the size of the crushing compartment. A can is crushed by placing it in the crushing compartment and moving the movable wall to reduce the size of the crushing compartment, thereby subjecting the can to a crushing operation. At least one of the other of the walls is aptly an opposing first fixed end wall towards which the moveable wall moves during a crushing operation.

In one embodiment, the compartment has a plurality of walls, and at least one other of the walls is aptly a side fixed wall extending generally between the movable wall and the first fixed end wall and along which the moveable wall runs and maintains close proximity to during a crushing operation.

In an embodiment, the compartment has a first fixed end wall at one end and the movable wall is an opposed wall which is moveable from a first position, away from the fixed wall, to a second position, closer to the fixed wall. In this embodiment, the opposing faces of the first fixed end wall and the movable wall may lie in mutually parallel planes.

Alternatively, it may be desired that the faces of the first fixed end wall and the movable wall lie in mutually skewed planes.

In both cases, the movable wall will be movable from a first position towards the first wall in a direction at right angles to the opposing face of the first fixed end wall.

Where the opposing faces of the first fixed end wall and the movable wall lie in mutually parallel planes, a can in the compartment in the crushing unit will be crushed along its longitudinal axis.

Where the faces of the first fixed end wall and the movable wall lie in mutually skewed planes, a can in the compartment in the crushing unit will be bent as well as crushed along its longitudinal axis.

The opposing faces of the first fixed end wall and the movable wall may be planar or smoothly curved. Alternatively, it may be desired that the faces of the first fixed end wall and/or the movable wall have one or more projections or protuberances, such as bumps, peaks, fingers or ridges, or depressions, such as craters, hollows, indentations or recesses, on or in them, to concentrate the crushing force in a limited area of the can (and hence increase the pressure to distort the can), so increasing the effect of the crushing force, and enabling it to be kept within the range of 200 to 600 kg, e.g. 300 to 500 kg, as mentioned hereinafter.

In one form of this embodiment, the compartment further comprises a second fixed end wall at an opposite end of the compartment from the first fixed end wall, the movable wall forming a partition wall placed between the first and second fixed end walls. Alternatively, the movable wall may also act as a second end wall. In both cases, the opposing faces of the first fixed end wall and of the second fixed end wall at an opposite end of the compartment from the first fixed end wall and/or the movable wall, may lie in mutually parallel planes. Alternatively, the faces of the first fixed end wall and the movable wall (whether it is a partition wall or the second end wall) may lie in mutually skewed planes. In both cases, the movable wall will be movable from a first position towards the first wall in a direction at right angles to the opposing face of the first fixed end wall.

In one form of this embodiment, the compartment also has at least one side wall, and the movable wall is a complementary shape to the side wall so that the moveable wall maintains close proximity to the side wall as the moveable wall runs along the side wall during a crushing operation.

In one form of this embodiment the compartment has a single continuous side wall, which is partially curved, so that the compartment has the form of an open trough with a curved bottom.

In one form of this embodiment, the compartment has a non-circular cross-section defined by a single side wall and a complementarily shaped partition wall. This shape helps to locate a cylindrical can in the centre of the compartment during the crushing process. In some embodiments, a drive means for the movable wall may tend to put a rotational motion on the movable wall. A compartment with a non-circular cross-section defined by a single side wall and a complementarily shaped movable wall ensures that the movable wall cannot rotate during a crushing operation.

Aptly, the fixed end wall or walls and the side walls are integral, and made from plastics material, e.g. glass filled ASS. Aptly, the partition wall is made from metal, e.g. a corrosion-resistant metal such as galvanized or stainless steel.

The crushing device may be operated manually, for example by a conventional lever pivotally attached to a fixed wall and to the movable wall. Aptly, however, the device comprises non-manual drive means for driving the movement of the moveable wall during the crushing operation. Aptly, the drive means comprises a reciprocating drive rod connected to the moveable wall. In the embodiment which has a second fixed end wall, the second fixed end wall is provided with an orifice and the drive rod extends through the orifice to connect the movable partition wall to the rest of the drive means.

The orifice may have a rim projecting into the compartment and running around the orifice, to prevent any liquid spillage up to a certain level in the compartment from a can received in the compartment escaping through the orifice and around the drive rod. Any such liquid spillage may escape through a slot in the side wall near the first fixed end wall into the bin in the storage unit below, described in more detail hereinafter.

The drive means may comprise a conventional motor, gearing and lead screw on a drive rod. Alternatively, the drive means comprises a linear ram, which is an electrically powered device connected to a linearly acting drive rod. This novel use of a linear ram in domestic appliances is particularly advantageous, as linear rams are sealed units, operate over a long life, allow easy replacement and reduce the need for significant control electronics.

The linear ram may alternatively be used to drive a scissor jack-type mechanism which in turn acts on the movable wall, either directly where the movable wall is a movable end wall or through a drive rod passing through the second fixed end wall, where the movable wall is a partition wall.

Alternatively, the drive rod may be moved by a hydraulic ram.

Where the module has a scissor jack-type mechanism operably connecting the drive means to the movable wall, the drive means acts on the scissor jack-type mechanism thereby to drive the wall during a crushing operation.

A scissor jack-type mechanism comprises a generally planar framework of pivotally joined members, for example defining at least one right parallelogram with an operational axis along a diagonal of the parallelogram, such that a force with a component applied to the framework transversely to the operational axis to compress the parallelogram in that direction extends it along the operational axis, and vice versa. Aptly, the scissor jack-type mechanism comprises at least two such frameworks lying in mutually parallel planes.

As noted hereinbefore, aptly, the drive means comprises a reciprocating drive rod operably connected to the movable wall, and for example a linear ram connected to a linearly acting drive rod with a drive rod operational axis.

The compartment and the drive means may have any position or orientation that is compatible with their role. For example, a linear drive rod connected to a linear ram may have an upright drive rod operational axis which lies in the elongate direction of the compartment.

Aptly, the crushing unit comprises a drawer and the storage unit also comprises a drawer which is operable independently of any crushing unit drawer. When the crushing unit and storage unit both comprise drawers, the crushing unit drawer is aptly located above the storage unit drawer. The position and orientation that the compartment and the drive means may have in such an embodiment are described further hereinafter.

The moveable wall may be releasably connected to the drive rod so that the wall is removable.

The end walls and the side walls may also be removable from the device. In the embodiment, where the end and side walls are an integral item, they are removable together as a single unit. Removability assists with maintenance of the device and cleaning of the compartment, for example in a dishwasher, where the compartment components are of plastics material and/or corrosion resistant metal.

Where the crushing unit comprises a drawer and a can crushing device, the drawer aptly runs horizontally on conventional sliders and/or rollers. The can crushing device may be mounted in the drawer in any convenient orientation, e.g. mounted with the elongate axis of the crushing compartment substantially horizontal. This embodiment may produce a more compact crushing unit. Where the drive means comprises a reciprocating drive rod operably connected to the movable wall, and for example a linear ram connected to a linearly acting drive rod with a drive rod operational axis, the drive rod operational axis will also aptly be substantially horizontal.

Where the drive means comprises a scissor-jack mechanism, the operational axis of the mechanism will also aptly be substantially horizontal. It may however be convenient to have the drive rod operational axis inclined from the horizontal, for example at an angle between 10° and 60°, such as 20° and 50°. Aptly, the drive means lies between two mutually parallel frameworks of a scissor jack-type mechanism.

In the form where the compartment also has at least one side wall, and the movable wall is a complementary shape to the side wall so that the moveable wall maintains close proximity to the side wall as the moveable wall runs along the side wall during a crushing operation, the crushing device is mounted in the drawer so that the side wall is at the bottom of the compartment, and supports the can during the crushing process. In the embodiment where the compartment has a single continuous side wall, which is partially curved, so that the compartment has the form of an open trough with a curved bottom, the device is aptly mounted with the open face of the trough uppermost and the curved bottom lowermost.

The can crushing device may be mounted in the drawer in any convenient orientation, with the elongate axis of the crushing compartment and the drive means extending transversely to the direction of sliding of the drawer. In one embodiment, the drawer is elongate in the direction of sliding of the drawer, and it is more convenient to have the generally elongate drive means and compartment run generally in the direction of sliding of the drawer, as this produces a more compact overall drive means. As noted hereinbefore, aptly, the drive means comprises a reciprocating drive rod operably connected to the movable wall, and for example a linear ram connected to a linearly acting drive rod with a drive rod operational axis. In such case, the movable wall in the compartment will be movable from a first position towards the first wall in a direction at right angles to the opposing face of the first fixed end wall forwardly in the direction of sliding of the drawer.

Where the drive means lies between two mutually parallel frameworks of a scissor jack-type mechanism, the planes of the frameworks will also lie in the direction of sliding of the drawer. Again, this produces a more compact overall drive means.

Aptly, the drawer has a drawer front. In one embodiment, the device is mounted in the drawer with the first fixed end wall adjacent the drawer front, for example supported by a drawer that conforms internally to the outside of the compartment. The drawer front then helps to reinforce the first fixed end wall during the crushing operation. Aptly, crushing takes place when the drawer is closed.

In the event that the drive means that is electrically powered, such as a linear ram, control electronics for the drive means are also housed in the crushing unit. The control electronics may include an initiation switch whose operation initiates a crushing operation. The switch may be operated directly by a user or may be operated indirectly as a result of some other operation by a user.

For instance, in the case where the crushing unit comprises a drawer, the initiation switch may be operated by the drawer itself, when it reaches its fully closed position. Similarly, the control electronics may include a sensor switch that switches the drive means so that it then retracts until the movable wall regains its rest position. The compartment is then ready to receive another can for crushing. Aptly, the control electronics comprise jam and overload detection, and failsafe switching to halt the crushing process.

The compartment may suitably have a rest position capacity in the range of 1500 to 2500 cu cm, for example about 2200 cu cm.

The compartment may suitably have a compaction ratio in the range of 4:1 to 6:1, for example about 5:1, where the compaction ratio is the ratio of the dimension of the compartment between the first fixed end wall and the movable wall at rest before the crushing operation and the same dimension to the position of the movable wall after the crushing operation.

The crush cycle, i.e. the time between the movable wall leaving and regaining its rest position may suitably be in the range of 5 to 9 seconds, e.g. 6 to 8 seconds.

The drive means, in particular when it comprises a linear ram may suitably exert a crushing force in the range of 200 to 600 kg, e.g. 300 to 500 kg.

Aptly, the storage unit also comprises a drawer which is operable independently of any crushing unit drawer. Aptly, when the crushing unit and storage unit both comprise drawers, the crushing unit drawer is located above the storage unit drawer. The storage unit drawer may have a front as well as solid sides, back and bottom, so as to form an open-top storage box. The front is suitably planar, and optionally rectangular.

Aptly, the storage unit drawer runs horizontally on conventional sliders and/or rollers below the can crushing device drawer.

Thus in one embodiment, described further hereinafter, two drawer members extend across the bottom of the drawer from a rear face of the drawer front rearwardly in the direction of sliding of the drawer from a position adjacent to the bottom right and bottom left hand corners of the drawer front respectively. In a form of this embodiment, two rollers are mounted on the bottom of the drawer at or adjacent to the rear of the drawer and the right and left hand corners of the drawer bottom, and in register with the members. Aptly, each member comprises a downwardly facing C-shaped channel.

The chassis comprises two rollers, each in a position adjacent to the chassis front, for example mounted in the chassis near the bottom front corners of the right and left hand sides of the chassis, and positioned and orientated such that they can engage the downwardly facing C-shaped channels on the drawer.

At least one load bearing chassis member extends across the bottom of the chassis from its front rearwardly in the direction of sliding of the drawer to the chassis rear and from side to side of the bottom of the chassis front respectively. The chassis member is positioned and orientated such that it can engage the rollers on the drawer.

Cans that are crushed in the crushing unit may be deposited into the box for storage. Cans may be taken from the crushing unit and placed in the box manually. However, it is preferable if cans are deposited directly from the crushing unit to the storage unit without user involvement.

One way of achieving this, in the case where the can crushing device is mounted in the drawer with the elongate axis of the crushing compartment horizontal or substantially horizontal (or sloping slightly downwards towards the first fixed end wall) and the compartment also has at least one side wall or part thereof which is at the bottom of the compartment, and supports the can during the crushing process, is for the side wall of the crushing compartment to include a slot adjacent to the first fixed end wall through which a crushed can may drop under gravity.

The slot should be so positioned that the crushed can drops into the storage box. The traverse of the driving means and the dimensions of any slot should aptly correspond to the compaction ratio. Where the faces of the first fixed end wall and the movable wall lie in mutually skewed planes in the compartment in the crushing unit, a can will be bent as well as crushed along its longitudinal axis, which may affect the compaction ratio, and hence the dimensions of any slot, and due account of this factor should be taken.

Aptly, the storage unit comprises a least one bin which is slidably locatable in the box. In the case where the box is positioned underneath a slot in the crushing unit compartment, one bin may be positioned below the slot, so that a crushed can drops into it. Once it is full of cans, the bin may be slidably removed from the box. For example, the bin may conform to the inside of part of the box such that it may be lifted into and out of the box with the crusher unit drawer closed and the storage unit drawer open.

Any remaining space in the box may be used for storing other waste or further bins may be located in the space, which may be swapped with the first bin when it is full. The or each bin may be shaped in a complementary interlocking fashion so as to facilitate specific locating of the or each bin and to prevent the or each bin from moving around.

In an alternative embodiment, the drawer does not form an open-top storage box with a bin which is slidably locatable in the box and is positioned underneath a slot in the crushing unit during the crushing operation and/or when the drawer is closed. Instead, the drawer has a front mounted on a container part, and the box is slidably locatable and sits in the drawer container part, and is positioned underneath a slot in the crushing unit during the crushing operation and/or when the drawer is closed, so that a crushed can drops into it.

Once the box is full of cans, the box may be slidably removed from the container part. For example, the box may conform to the inside of at least part of the box such that it may be lifted into and out of the box with the crusher unit drawer closed and the storage unit drawer open.

There is no remaining space in the container part if the box conforms to all the inside of the container part. If, however, the box conforms to the inside of only a part of the container part, the remainder of the container part may house one or more bins for storing other waste, or the or a bin located in the container part may replicate the box in form, and may be swapped with the box when it is full.

The or each bin and/or the box may be shaped in a complementary interlocking fashion so as to facilitate specific locating of the or each bin and/or the box to prevent the or each bin and/or the box from moving around in use.

The drawer front is suitably planar, and aptly rectangular. Aptly, the container part conforms to the box, so that it holds the box. The container part may be an open framework, e.g. it may have a cage-like structure formed by intersecting members.

In one form of this embodiment, the cage-like container part comprises members which are first, second and third arms, wherein each arm extends from a rear face of the drawer front rearwardly in the direction of sliding of the drawer. In a form of this embodiment, the arms further extend transversely of the direction of sliding of the drawer to meet adjacent to the rear of the drawer. In particular, the arms are so arranged that they conform to the outside of the box, so that they hold the box. In a form of this embodiment, the cage-like container part has no members extending transversely across the bottom of the container part.

Suitably, when the front is planar and rectangular, the first arm extends from a point adjacent the bottom edge of the drawer front, aptly at or near the centre of the bottom edge, and the second and third arms extend from a position adjacent to the top right and left hand corners of the drawer front respectively.

Aptly, each arm comprises a C-shaped channel and the chassis comprises three runners, each in a position corresponding to one of the first, second and third arms, wherein each of the C-shaped channels slots and runs over a corresponding runner, optionally with rolling means between the arm and the channel.

Aptly, the C-shaped channel of the first arm lies in one plane and the C-shaped channel of each of the other arms lies in a another plane, perpendicular to the first plane.

Aptly, each runner comprises first and second members, wherein the first member is mounted on the chassis, extending rearwardly in the direction of sliding of the drawer from the front of the module and the second member loosely conforms internally to the outside of the first member and is held captive by a C-shaped channel that slots and runs over the corresponding runner second member. This arrangement allows the runner to float within controlled limits to take up any inaccuracies in the cage-like container part.

Drawer runners usually tend to be rigid in one direction only. Thus, each of the runners in a lateral position corresponding to one of the second and third arms, and over which each of the C-shaped channels slots and runs, are rigid to vertical motion but not lateral. The bottom runner in a position corresponding to the first arm, and over which the C-shaped channels slots and runs, is rigid to lateral motion but not vertical. The bottom runner makes the top runners more rigid laterally and the top runners make the bottom runner more rigid vertically.

The perpendicular relationship of the first channel and the second and third channels and between the corresponding runners gives rise to a triangulated structure, which means that the drawer is stable when it is slid in and out and prevented from rocking or rotating, and which prevents runners binding, e.g. a pair of lower runners and channels in parallel with a pair of upper runners and channels preventing the latter from running smoothly, or vice versa.

Aptly, the module is constructed of plastics materials, such as high density polypropylene, on a galvanized or stainless steel chassis, for lightness, speed of replacement if damaged, and lower cost.

The module may serve as a stand-alone can crushing and storing module consisting essentially of a can crushing unit and a storing unit.

In an alternative embodiment, the module may suitably comprise a cuboidal chassis, and the crushing unit is aptly mounted in, and adjacent to a top side edge of, the chassis, extending rearwardly in the direction of sliding of the crushing unit drawer from the front of the chassis.

In this alternative embodiment, the module may suitably also comprise a compacting and storing module for paper, cardboard cartons or cardboard or plastics material containers, of the type described in our copending application, comprising a receptacle, drive means and a compacting means, wherein the drive means is operably connected to the compacting means.

During a compacting operation, the drive means drives the compacting means into the receptacle. Any cartons, packaging or containers in the receptacle are compacted by the action of the compacting plate. Following a compacting operation, the drive means drives the compacting plate in a withdrawing operation out of the receptacle, which [[the]] then acts as a storage unit for compacted recyclable waste materials.

Aptly, during a compacting operation, the drive means drives the compacting means downwardly into the receptacle from a rest position clear of the receptacle before the compacting operation. Aptly, the compacting means is in the form of a compacting plate, aptly a planar and rectangular plate which extends in a generally horizontal direction under the crushing unit and the compacting drive means.

In this form of the embodiment, the drive means of the compacting and storing module for paper, cardboard cartons or cardboard or plastics material containers is mounted in, and adjacent to the other top side edge of, the chassis than that where the crushing unit is mounted, and also extends rearwardly in the direction of sliding of the crushing unit drawer from the front of the chassis.

Aptly, the compacting drive means and the crushing unit abut each other laterally. Although each component of the module performs different functions, it is then convenient to have the compacting drive means and the crushing unit share a common storage unit, mounted in the module on the chassis.

The common storage unit, the receptacle, is positioned below the crushing unit and the compacting drive means.

As noted above, the crushing compartment may include a slot adjacent to the first fixed end wall through which a crushed can may drop under gravity, and in the rest position of both, the receptacle is positioned underneath the slot in the crushing unit compartment. The compacting plate extends in a generally horizontal direction under the crushing unit and the compacting drive means, but in this form of the embodiment, it only extends forwards in the direction of sliding of the crushing unit drawer from the rear of the chassis for its front edge to overlap the rear part of the slot in the crushing unit compartment and to define a space behind the receptacle drawer front.

The crushing compartment is slidable out of the front of the chassis from the rear of the chassis in a direction generally corresponding to its elongate dimension after a crushing operation (during which the crushing unit drawer is closed).

A crushed can will be retained in the slot adjacent to the first fixed end wall by the compacting plate until withdrawal of the crushing unit, when the slot clears the front edge of the compacting plate, so that a crushed can drops under gravity through the space in front of the compacting plate into the receptacle.

Suitable storage units include the alternative embodiment of a storage unit drawer described hereinbefore, in which the drawer has a front mounted on a container part, and a receptacle is slidably locatable and sits in the drawer container part. As above, the drawer front is suitably planar, and aptly, rectangular. Aptly, the container part conforms to the receptacle, so that it holds the receptacle. The container part may be an open framework, e.g. it may have a cage-like structure formed by intersecting members.

In one form of this embodiment, the cage-like container part comprises members which are first, second and third arms, wherein each arm extends from a rear face of the drawer front rearwardly in the direction of sliding of the drawer.

In a form of this embodiment, the arms further extend transversely of the direction of sliding of the drawer to meet adjacent to the rear of the drawer. In particular, the arms are so arranged that they conform to the outside of the box, so that they hold the receptacle.

Drawer runners usually tend to be rigid in one direction only. Thus, each of the runners in a lateral position corresponding to one of the second and third arms, and over which each of the C-shaped channels slots and runs, are rigid to vertical motion but not lateral. The bottom runner in a position corresponding to the first arm, and over which the C-shaped channels slots and runs, is rigid to lateral motion but not vertical. The bottom runner makes the top runners more rigid laterally and the top runners make the bottom runner more rigid vertically.

In a form of this embodiment, the cage-like container part has a first arm towards the bottom of the chassis in perpendicular relationship with second and third arms towards the sides of the chassis to give the drawer stability when it is slid in and out and prevent it rocking or rotating, and to prevent the drawer runners binding.

In a form of this embodiment, the receptacle has an open-top generally cuboidal box-shaped structure, optionally splaying slightly on all sides in the direction of the top side of the chassis, and a projecting lip extending in a generally horizontal direction on all sides from the top of the receptacle. The receptacle is supported by the lip solely on the second and third arms extending from a rear face of the drawer front rearwardly in the direction of sliding of the drawer, and not on the first arm towards the bottom of the chassis.

Aptly, the module has a chassis and the at least one load bearing member is mounted on or part of the chassis. In a form of this embodiment, the at least one load bearing member is so positioned that when the drawer is fully slid in, it supports the receptacle clear of the bottom of the container part. The load bearing member or members may have any position or orientation that is compatible with the supporting role.

Aptly, the receptacle and/or the container part, in particular the receptacle, has rolling means, such as wheels or rollers, mounted in or on its bottom, aptly symmetrically about the longitudinal axis of the receptacle in the direction of sliding of the drawer.

The receptacle may have a rectangular bottom which extends in a generally horizontal direction, with rolling means aptly mounted adjacent to the corners of the bottom and projecting downwardly clear of the container part to engage the load bearing member or members when the drawer is slid in.

In a form of this embodiment, a single load bearing member is mounted on, and extends over most of the bottom of the module.

A runner in a position corresponding to the first arm, and over which a C-shaped channel of that arm slots and runs, is mounted on the single load bearing member, which is disposed and extends on each side of the first arm of the container part, aptly symmetrically.

Aptly, each runner comprises first and second members, wherein the first member is mounted on the chassis, extending rearwardly in the direction of sliding of the drawer from the front of the module and the second member loosely conforms internally to the outside of the first member and is held captive by a C-shaped channel that slots and runs over the corresponding runner second member. This arrangement allows the runner to float within controlled limits to take up any inaccuracies in the cage-like container part. Drawer runners usually tend to be rigid in one direction only. Thus, each of the runners in a lateral position corresponding to one of the second and third arms, and over which each of the C-shaped channels slots and runs, are rigid to vertical motion but not lateral. The bottom runner in a position corresponding to the first arm, and over which the C-shaped channels slots and runs, is rigid to lateral motion but not vertical. The bottom runner makes the top runners more rigid laterally and the top runners make the bottom runner more rigid vertically.

The perpendicular relationship of the first channel and the second and third channels and between the corresponding runners gives rise to a triangulated structure, which means that the drawer is stable when it is slid in and out and prevented from rocking or rotating, and which prevents runners binding, e.g. a pair of lower runners and channels in parallel with a pair of upper runners and channels preventing the latter from running smoothly, or vice versa.

In one embodiment, the profile from the side of each load bearing member comprises, in sequence from front to back of the module underneath the container, a first inclined part which is inclined upwardly from the front of the module towards the back, a high projecting part extending in a generally horizontal direction from front to back of the module, a second inclined part which is inclined downwardly from front to back of the module, and a low depressed part, at least part of which is nearest the back of the module.

The front and rear pairs of rolling means, such as wheels or rollers, are in not in register in the direction of sliding of the drawer.

The second inclined part and the low depressed part comprise first sections in the same sequence from front to back of the module which are near the front of the module and second sections which are nearest the back of the module respectively, and are not in register in the direction of sliding of the drawer.

There is a lateral line adjacent to the front bottom edge of the module where the profile of the or each load bearing member changes from the first inclined part which is inclined upwardly from the front of the module towards the back to the high projecting part extending in a generally horizontal direction from front to back of the module.

In an embodiment of the module, the or each load bearing member has rolling means, such as wheels or rollers, mounted in or on it along and at right angles to that line.

Aptly, a pair of rolling means, such as wheels or rollers, is mounted symmetrically about the runner corresponding to the first arm, and over which the C-shaped channel of that arm slots and runs.

The rolling means are mounted in a pair of depressions, such as niches, recesses or slots, such that the rolling means projects upwardly of the load bearing member to each side of the runner, so that it may engage the bottom of the receptacle and ease the passage of the drawer as it is slid in. This pair of rolling means is not in register in the direction of sliding of the drawer with the pairs of rolling means, such as wheels or rollers, in or on the receptacle.

As the drawer is slid fully in, the rear bottom edge of the receptacle and/or the rolling means, such as wheels or rollers, mounted therein or thereon, runs down at least a section of the second incline where it comes to rest on at least a section of the low depressed part.

In a form of this embodiment, the low depressed part, and optionally the second inclined part, comprises first sections in the same sequence from front to back of the module which are near the front of the module and second sections which are nearest the back of the module respectively. The respective first and second sections are not in register in the direction of sliding of the drawer.

Aptly, the first sections of the low depressed part, and optionally of the second inclined part are in the first inclined part at or near the front edge of the bottom of the module.

In this form, the rear bottom edge of the receptacle and/or the rolling means, such as wheels or rollers, mounted therein or thereon, runs down the second section of the second incline and comes to rest on the second section of the low depressed part.

At the same time, the front bottom edge of the receptacle and/or the rolling means, such as wheels or rollers, mounted therein or thereon, runs down the optional first section of the second incline (if present) and comes to rest on the first section of the low depressed part. The load of the receptacle is then completely taken by the load bearing member or members and no longer by the second and third arms towards the sides of the chassis and second and third arms extending from a rear face of the drawer front rearwardly in the direction of sliding of the drawer.

Aptly, the short incline part and the low depressed part are in the form of depressions, such as niches, recesses or slots, which are capable of receiving the rolling means, such as wheels or rollers mounted in or on the edges of the receptacle, keeping the receptacle in place during waste compaction.

The module of this invention may serve as a stand-alone appliance in its own right or it may be combined with one or more other modules to form an integrated appliance, for example by way of a simple bolting process.

For instance, another module could compact and store cardboard or plastics material cartons, and yet another module could store glass. The same module design can be used in either mode without adaptation.

For instance, another module could compact and store paper, cardboard cartons or cardboard or plastics material containers; and yet another module could store glass.

The same module design can be used in either mode without adaptation.

Referring to the embodiment of the crushing unit which uses a linear ram to drive a movable wall to reduce the size of the crushing compartment, a linear ram has not been used hitherto in a domestic can crushing unit.

Accordingly, in a second aspect the invention provides a domestic can crushing unit comprising a linear ram and an elongate crushing compartment having at least two, and aptly a plurality of walls, wherein at least one of the walls is moveable under the action of the linear ram during a crushing operation thereby to reduce the size of the crushing compartment.

Embodiments of this can crushing unit and its components are as so described in relation to corresponding integers in relation to the can crushing and storage unit hereinbefore. In some embodiments, the linear ram drive means for the movable wall may tend to put a rotational motion on the drive rod and hence on the movable wall.

A compartment with a non-circular cross-section defined by a single side wall and a complementarily shaped movable wall (whether it is a partition wall or a second end wall) ensures that the movable wall cannot rotate during a crushing operation. This may be in the form of a U-shaped trough compartment with a complementarily U-shaped movable wall, which cannot rotate during a crushing operation.

Alternatively, where the faces of the first fixed end wall and the movable wall lie in mutually skewed planes in a compartment with a partially circular cross-section, e.g. defined by a single side wall, the movable wall which is complementarily shaped to the circular part of the compartment cross-section will be elliptical, and will not be able to rotate during a crushing operation.

Alternatively, a compartment with a partially circular cross-section, e.g. defined by a single side wall and a circular movable wall which is complementarily shaped to the circular part of the compartment cross-section could be used with an anti-rotation guide on the linear ram itself.

BRIEF DESCRIPTION OF THE DRAWINGS

The present invention will now be described hereinafter by way of example only with reference to the following Figures, in which.

DETAILED DESCRIPTION OF THE INVENTION

Figure 1:
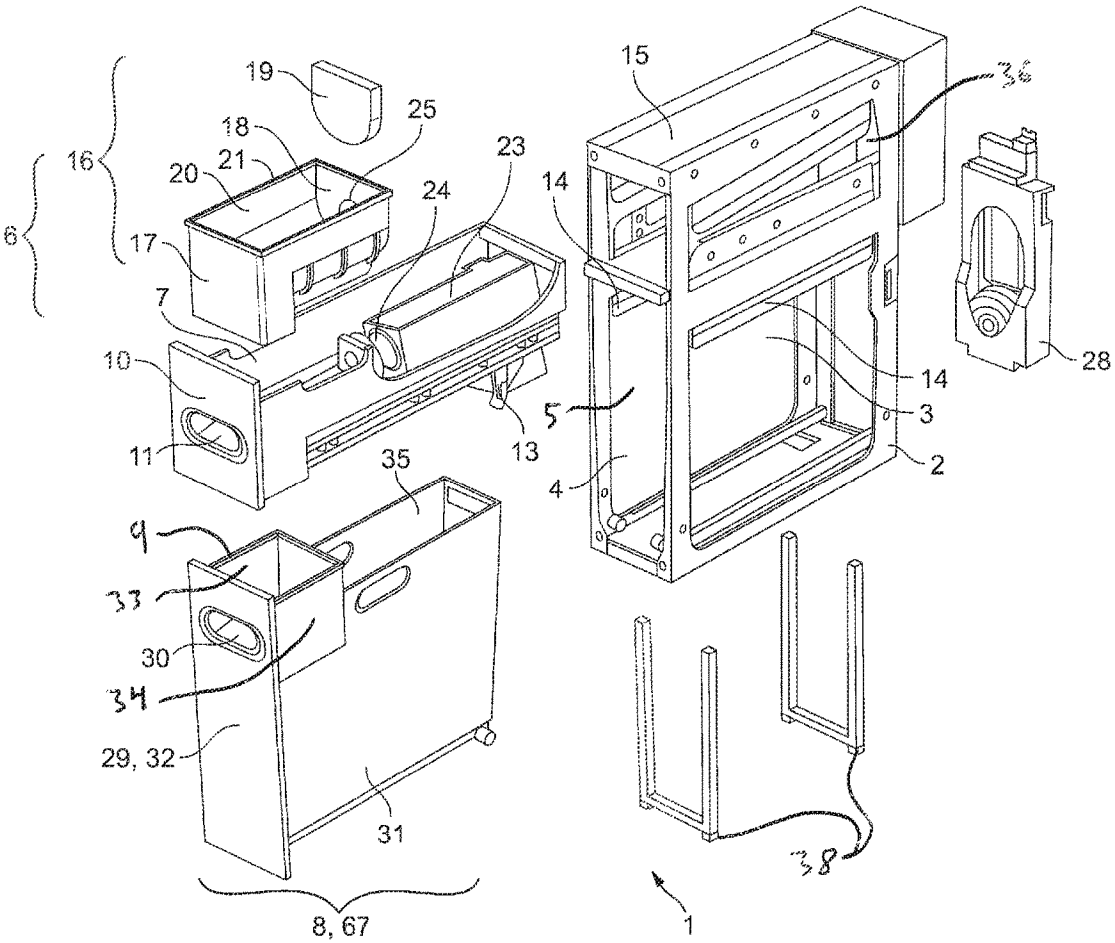
FIG. 1 shows an exploded isometric view of a can crushing and storing module according to the present invention.

Referring to FIG. 1, the can crushing and storing module 1 has a chassis 2 comprising a framework consisting of metal members defining a rectangular box-shaped space 3.

Adjustable leg units 38 are slidably received in the bottom of the chassis 2, adjacent to the chassis front and back.

The space 3 is enclosed on all sides apart from the front 4 by a plastics material skin 5. The module 1 has an upper, can crushing unit 6 comprising a first drawer 7, occupying approximately the top one third of the volume of the space 3, and a lower storage unit 8, comprising a second drawer 9, occupying the remaining two thirds of the volume of the space 3.

Figure 2:
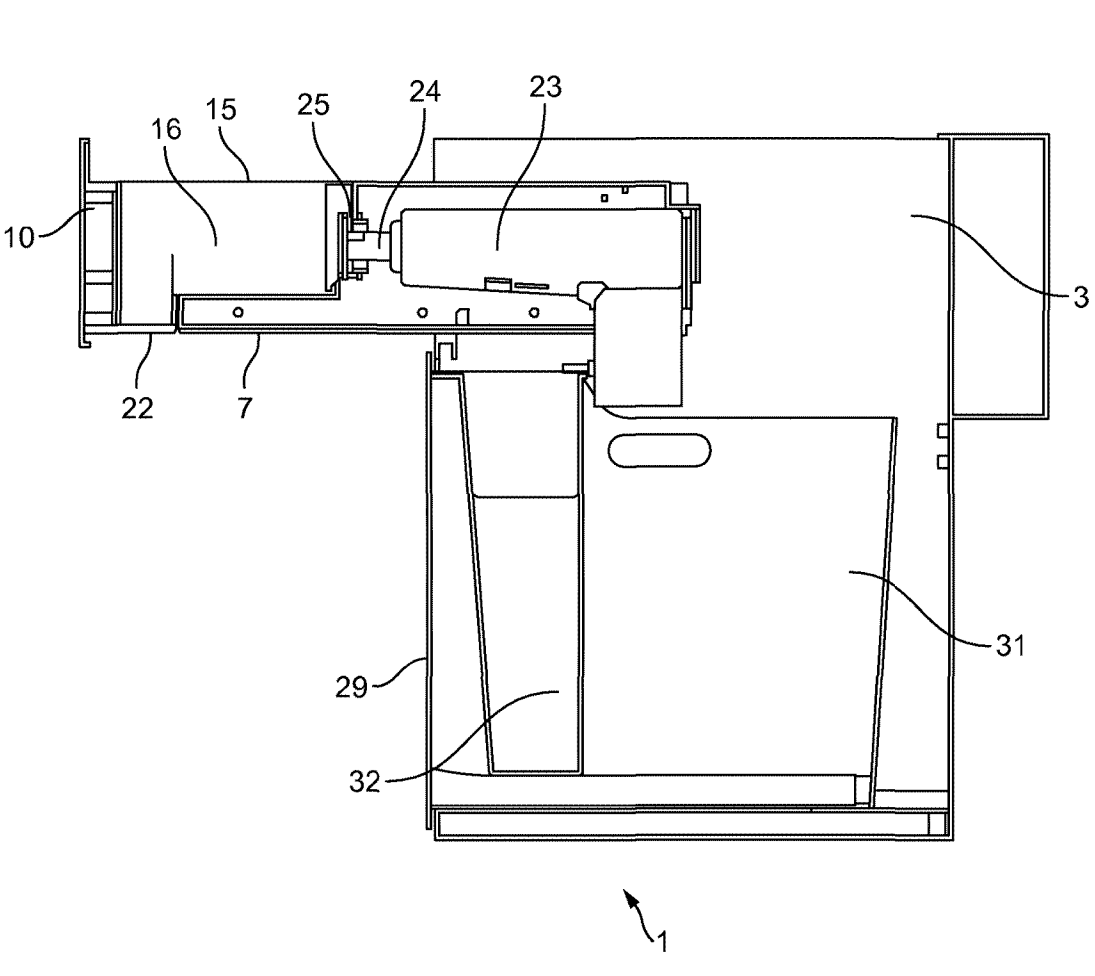
FIG. 2 shows a side view of the can crushing and storing module of FIG. 1 with the crushing unit drawer pulled outwardly of the module in use.
Figure 2:
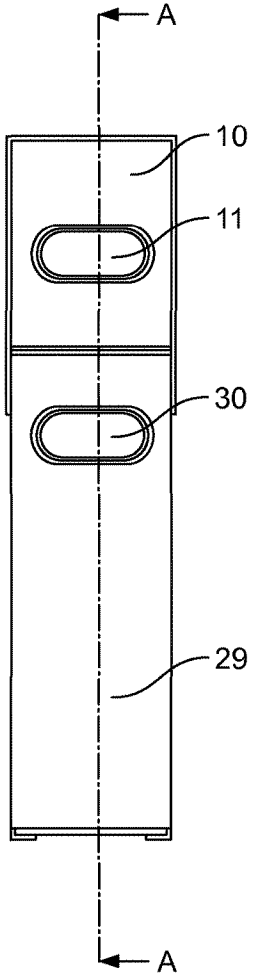
Figure 3:
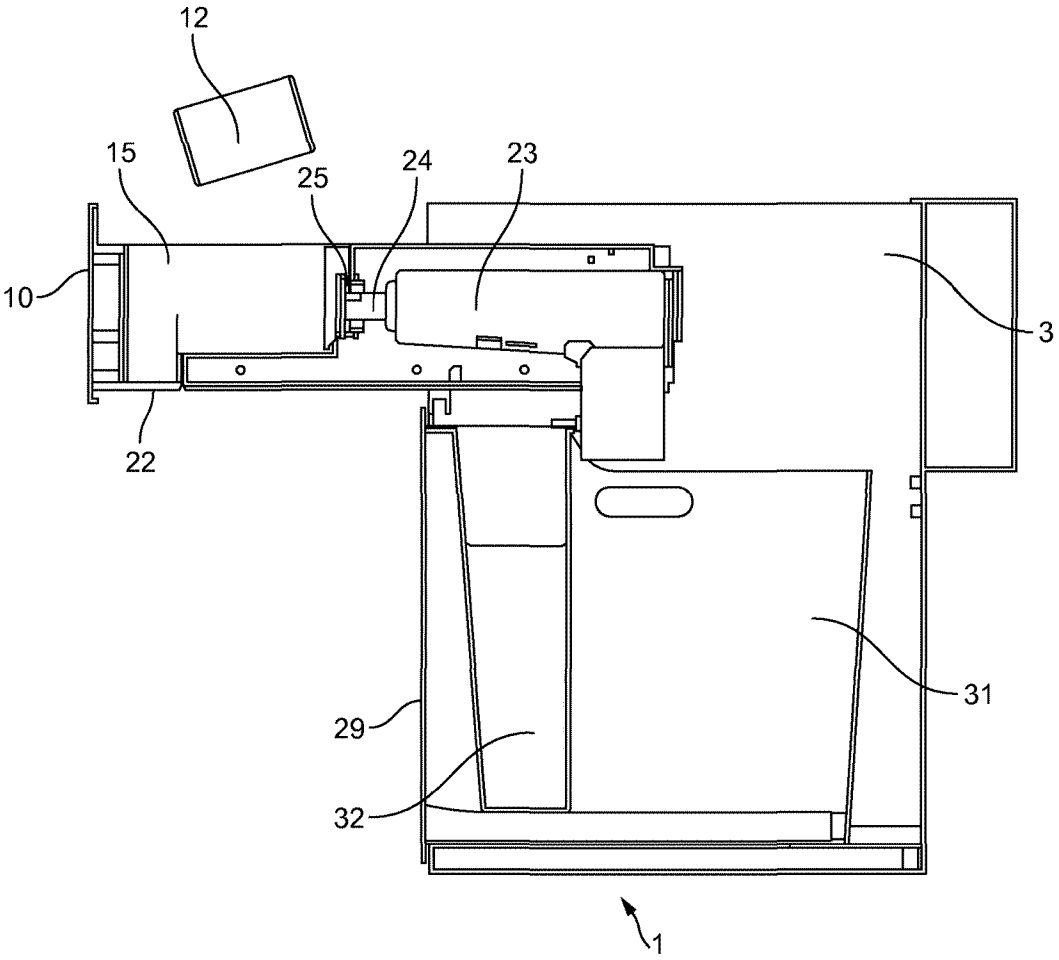
FIG. 3 shows a side view of the can crushing and storing module of FIG. 1 with a can being put into the crushing unit drawer of the module in use.
Figure 4:
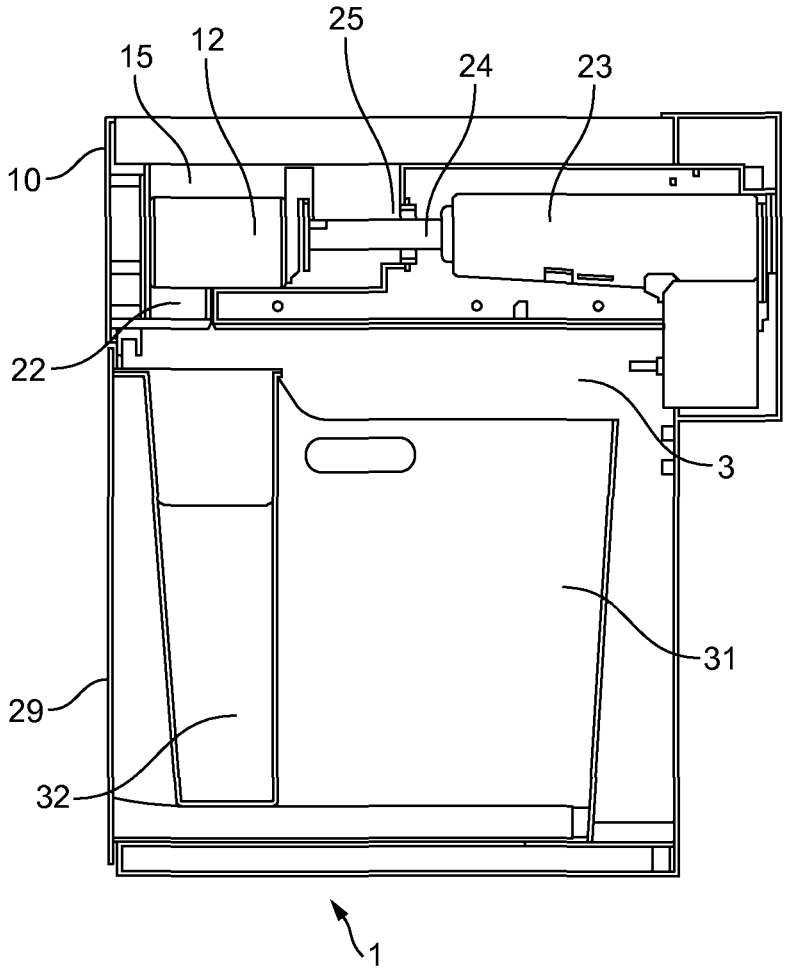
FIG. 4 shows a side view of the can crushing and storing module of FIG. 1 with a can in the crushing unit drawer, which has been pushed inwardly of the module in use.
Figure 5:
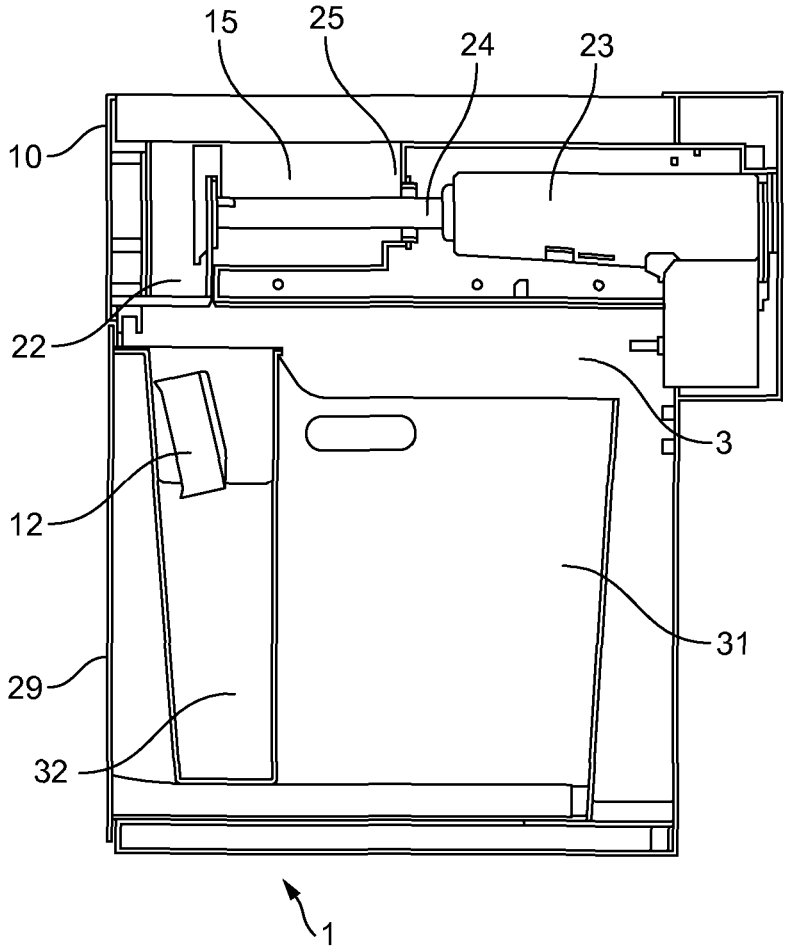
FIG. 5 shows a side view of the can crushing and storing module of FIG. 1 with a crushed can being dropped from the crushing unit drawer of the module in use.
Figure 6:
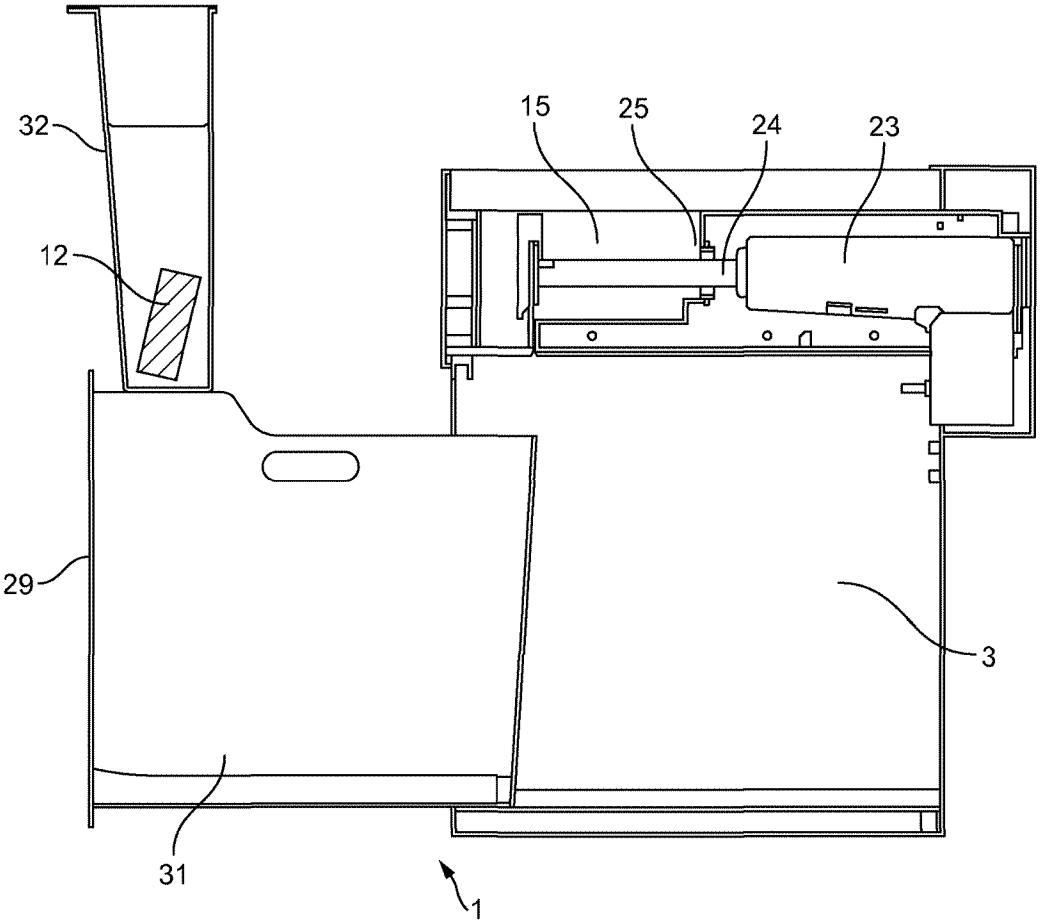
FIG. 6 shows a side view of the can crushing and storing module of FIG. 1 with the storage unit pulled outwardly of the module in use.

Referring to FIGS. 1 and 2, the first drawer 7 comprises a drawer front 10 including a recess handle 11. The first drawer 7 has a pair of side rails 13, 13 which sit on a corresponding pair of runners 14, 14 fastened to the chassis 2.

In the first drawer 7, mounted on the rails 13, 13 is a can crushing device 15 comprising a can crushing compartment 16.

The can crushing compartment 16 has a first fixed end wall 17 adjacent to the drawer front 10, a second fixed end wall 18 at the opposite end of the compartment 16 to the drawer front 10, and a moveable partition wall 19 which, in the resting state of the crushing unit 6, sits adjacent the second fixed end wall 18.

A continuous, partially curved side wall 20 extends around all sides of the device 15 apart from the side 21 serving as an opening to the compartment 16. At the end of the compartment 16 nearest the first fixed end wall 17 there is a slot 22 in the side wall 20.

The fixed end walls 17, 18 and the side wall 20 of the compartment 16 are a unitary construction, made from plastics material. The partition wall 19 is made from metal, here stainless steel.

The device 15 further comprises a linear ram 23 fixed to the drawer 7 within the space 3 of the storing and crushing module 1.

The linear ram 23 is an electrically powered device that has a reciprocating drive rod 24. The electrical power unit 28 for the ram is mounted on the back of the chassis 2.

The second fixed end wall 18, at the end of the compartment 16 remote from the drawer front 10, includes an orifice 25. The drive rod 24 extends in the direction of opening the drawer 7, through the orifice 25. The orifice 25 has a rim projecting into the compartment 16 and running around the orifice 25, to prevent any liquid spillage up to a certain level in the compartment 16 from a can 12 received in the compartment 16 escaping through the orifice 25 and around the drive rod 24. Any such liquid spillage may escape through the slot 22 in the side wall 20 near the first fixed end wall 17 into the bin 32 in the storage unit 8 below.

The free end of the drive rod 24 is releasably connected to the partition wall 19. The drive rod 24 has a T-piece at its free end and the partition wall 19 includes a slot, and the partition wall 19 slots over the T-piece. The T-piece may be mounted in any of four orthogonal orientations on the square end of the linear ram 23 allowing four orthogonal orientations in which the linear ram may be mounted in the drawer 7.

The partition wall 19 is freely moveable within the compartment 16 and, during a crushing operation, when the linear ram 23 drives the drive rod 24 in the direction of opening the drawer 7, the partition wall 19 is moved in the compartment 16 towards the first fixed end wall 17. This reduces the size of the can-crushing space such that any can received in the space is crushed.

The profile of the partition wall 19 matches the profile of the side wall 20 so that the partition wall 19 maintains a close contact with the side wall 20 as it moves through the device 15 and, because the profile is non-circular, the partition wall 19 is maintained aligned and prevented from rotating under any rotational torque from the linear ram 23.

A crushing operation initiation switch 36 is mounted on the chassis 2 at a position opposite the back of the drawer 7, such that closing the drawer 7 completely will activate the switch 36.

The second, lower drawer 9 has a drawer front 29 including a recess handle 30. The lower drawer 9 has solid sides, back and bottom forming an open box 31. An open-ended generally box-shaped bin 32, which is smaller than the drawer 9, is slidably received in the drawer 9, adjacent the drawer front 29.

The neck 33 of the bin 32 has an increased width portion 34, and the upper part of the drawer 9 has a similarly increased width to accommodate the increased width neck portion 34 of the bin 32 so that bin 32 and drawer 9 fit together in an interlocking fashion. In this way, the specific location of the bin 32 is ensured and the bin 32 is prevented from moving around in the drawer 9.

The remaining space 35 in the drawer 9, which is not occupied by the bin 32, is used for storing other recyclable waste.

In the resting state of the crushing and storing module 1, both the top and bottom drawers 7, 9 are closed.

Referring to FIGS. 2 to 6, the first drawer 7 comprises a drawer front 10 including a recess 11.

A crushing operation involves opening the top drawer 7 and placing a can 12 for recycling in the device 15. The top drawer 7 is then closed. As the drawer 7 reaches its fully closed position, the drawer actuates the crushing operation initiation switch 36 which activates the linear ram 23 under the control of its control circuitry. Activation causes the drive rod 24 to extend in the direction of opening the drawer 7 so as to drive the partition wall 19 in the direction of the first fixed end wall 17, thereby reducing the size of the compartment 16 and crushing the can 12 received in the compartment 16.

The drive rod 24 continues to extend so as to move the partition wall 19 to a position beyond the edge of the slot 22 in the side wall 20 nearest the partition wall 19. By that point, the can 12 will have been crushed to a size smaller than the slot 22, whereupon the crushed can 12 drops through the slot 22 into the bin 32 in the storage unit 8 below.

A sensor switches the linear ram 23 so that it then retracts the drive rod 24 until the partition wall 19 is again positioned adjacent the second fixed end wall 18. The compartment 16 is then ready to receive another can 12 for crushing.

Figure 7B:
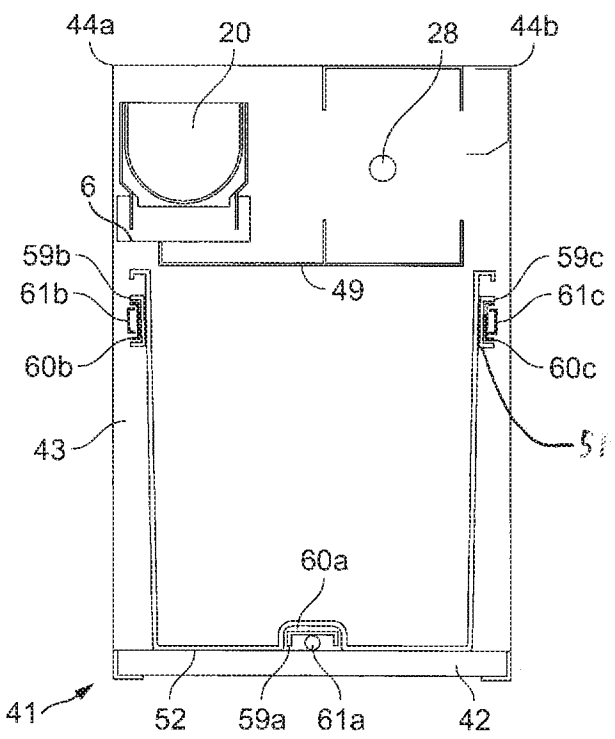
FIG. 7*b* shows a cross-sectional view from the longitudinal mid-point of the extended module of FIG. 7*a* facing rearwardly.
Figure 7A:
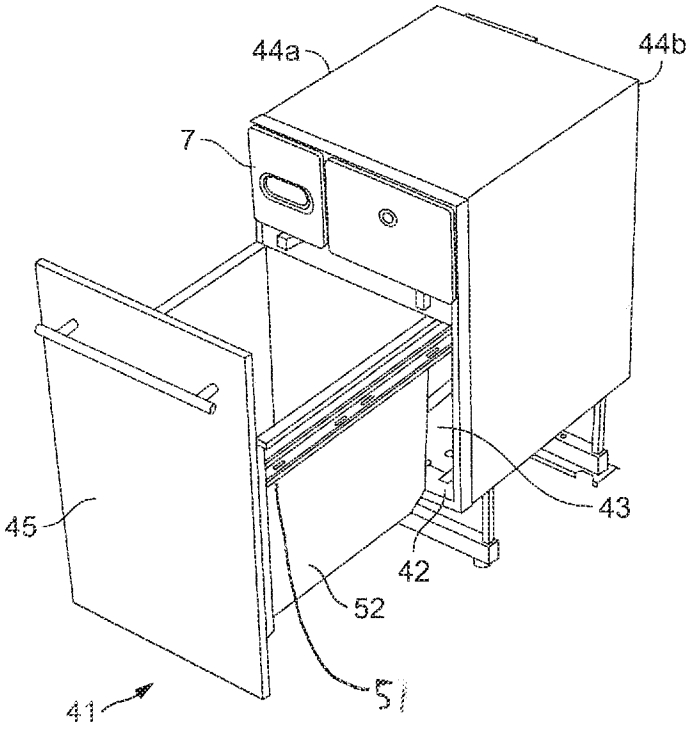
FIG. 7*a* shows an isometric view of an extended module comprising two different modules for crushing, compacting and storing recyclable waste, including the can crushing and storing module of FIG. 1.

Referring to FIGS. 7*a* and 7*b*, a recycling extended module is indicated generally at 41.

The term "extended module" as used herein refers to a module for crushing and/or compacting recyclable waste materials which comprises two or more sub-modules. Each sub-module of the extended module performs a different function, such as a sub-module for crushing cans and storing the crushed cans, or for compacting paper, cardboard cartons or cardboard or plastics material containers and storing the compacted materials.

The extended module 41 illustrated comprises two different modules:

A can crushing unit 6 comprising a first drawer 7, mounted in, and adjacent to the top left side edge 44*a* of, the chassis 42 of the extended module 41, occupying approximately half of the top one third of the volume of the space 43 within the chassis 42, and extends rearwardly the front of the chassis 42.

An electrically powered drive means of a compacting and storing module for paper, cardboard cartons or cardboard or plastics material containers is mounted in, and adjacent to the right top side edge 44*a* of, the chassis 42, also occupying approximately half of the top one third of the volume of the space 43 within the chassis 42, and extends rearwardly the front of the chassis 42. The drive means is operably connected to a compacting means, here a planar and rectangular compacting plate 49 which extends in a generally horizontal direction.

The drive means and the crushing unit 6 abut each other laterally. Although each component of the module performs different functions, the compacting drive means and the crushing unit 6 share a common storage unit 45.

The common storage unit is a storage unit drawer 45 with a cage-like container part 51 and an open-top generally box-shaped receptacle 52, which is smaller than the container part 51 and is slidably received in the container part 51.

The storage unit drawer 45 is slidably mounted in the chassis 2 below the crushing unit 6 and the compacting drive means, such that in use a crushed can 12 drops into it and the drive means drives the compacting means downwardly into the receptacle 52 from a rest position clear of the receptacle 52 before the compacting operation, such that any cans, cartons, packaging or containers in the receptacle 52 are compacted. The drawer 45 occupies the remaining two thirds of the volume of the space 3.

As noted above, the can crushing compartment 16 includes a slot 22 adjacent to the first fixed end wall 17 through which a crushed can 12 may drop under gravity, and in the rest position of both units, the receptacle 52 is positioned underneath the slot 22 in the crushing unit compartment 16. The compacting plate 49 extends in a generally horizontal direction under the crushing unit 6 and the compacting drive means, but it only extends forward in the direction of sliding of the crushing unit drawer 7 from the rear of the chassis 2 for its front edge to overlap the rear part of the slot 22 in the crushing unit compartment 16 and to define a space behind the receptacle drawer front 61.

The crushing compartment 16 is slidable out of the front of the chassis 2 from the rear of the chassis 2 in a direction generally corresponding to its elongate dimension after a crushing operation (during which the crushing unit drawer 7 is closed). A crushed can 12 will be retained in the slot 22 adjacent to the first fixed end wall 17 by the compacting plate 49 until withdrawal of the crushing compartment 16, when the slot 22 clears the front edge of the compacting plate 49, so that a crushed can 12 drops under gravity through the space in front of the compacting plate 49 into the receptacle 52.

The cage-like container part 51 comprises members which are first, second and third arms 59*a*, 59*b*, 59*c*, wherein the arms 59*a*, 59*b*, 59*c* extend from a rear face 60 of a drawer front 61 rearwardly in the direction of sliding of the drawer 45.

They further extend transversely of the direction of sliding of the drawer 45 to meet adjacent to the rear of the drawer 45. The arms 59*a*, 59*b*, 59*c* are so arranged that they conform to the outside of the receptacle 52 to hold the receptacle 52.

The cage-like container part 51 so formed has a first arm 59*a* in perpendicular relationship with second and third arms 59*b*, 59*c*. Each arm 59*a*, 59*b*, 59*c* comprises a C-shaped channel 60*a*, 60*b*, 60*c* and the chassis 2 comprises three runners 61*a*, 61*b*, 61*c*, each in a position corresponding to one of the first, second and third arms 59*a*, 59*b*, 59*c*. Each of the C-shaped channels 60*a*, 60*b*, 60*c* slots and runs over a corresponding runner 61*a*, 61*b*, 61*c*.

Each runner 61*a*, 61*b*, 61*c* comprises first and second members (not shown), wherein the first member is mounted on the chassis 2, extending rearwardly in the direction of sliding of the drawer 45 from the front of the module 41 and the second member loosely conforms internally to the outside of the first member and is held captive by a C-shaped channel, respectively 60*a*, 60*b*, 60*c*, that slots and runs over the corresponding runner second member. This arrangement allows each runner 61*a*, 61*b*, 61*c* to float within controlled limits to take up any inaccuracies in the cage-like container part 51.

Drawer runners usually tend to be rigid in one direction only. Thus, each of the runners in a lateral position corresponding to one of the second and third arms, and over which each of the C-shaped channels slots and runs, is rigid to vertical motion but not lateral. The bottom runner in a position corresponding to the first arm, and over which the C-shaped channels slots and runs, is rigid to lateral motion but not vertical. The bottom runner makes the top runners more rigid laterally and the top runners make the bottom runner more rigid vertically.

The perpendicular relationship of the first channel and the second and third channels and between the corresponding runners gives rise to a triangulated structure, which means that the drawer is stable when it is slid in and out and prevented from rocking or rotating, and which prevents runners binding, e.g. a pair of lower runners and channels in parallel with a pair of upper runners and channels preventing the latter from running smoothly, or vice versa.

The C-shaped channel 60*a* of the first arm 59*a* lies in one plane on the bottom 63 of the chassis 2, and the C-shaped channel 60*b*, 60*c* of each of the other arms 59*b*, 59*c* lies in another plane, perpendicular to the first plane.

The perpendicular relationship of the first channel 59*a* and the second and third channels 59*b*, 59*c* give the drawer 45 stability when it is slid in and out and prevent it rocking or rotating, and prevent the drawer runners binding.

In use, a can 12 may be crushed in the crushing unit 6 as described hereinbefore in relation to FIGS. 2 to 6, with the crushed can 12 being dropped from the crushing unit drawer 7 into the receptacle 52, which acts as a storage unit for compacted recyclable waste materials.

Alternatively or subsequently, the drawer 45 is slid outwards, and paper, cardboard cartons or cardboard or plastics material containers are put into the receptacle 52. The drive means drives the compacting plate 49 downwardly into the receptacle 52 from a rest position clear of the receptacle 52 before the compacting operation, such that any cans, cartons, packaging or containers in the receptacle are compacted. Following a compacting operation, the drive means drives the compacting plate 49 in a withdrawing operation out of the receptacle 52 to its rest position clear of the receptacle 52 before the compacting operation.

Aptly, the compacting means is in the form of a compacting plate, e.g. a planar and rectangular plate which extends in a generally horizontal direction. The receptacle 52 then acts as a storage unit for compacted recyclable waste materials.

Figure 8:
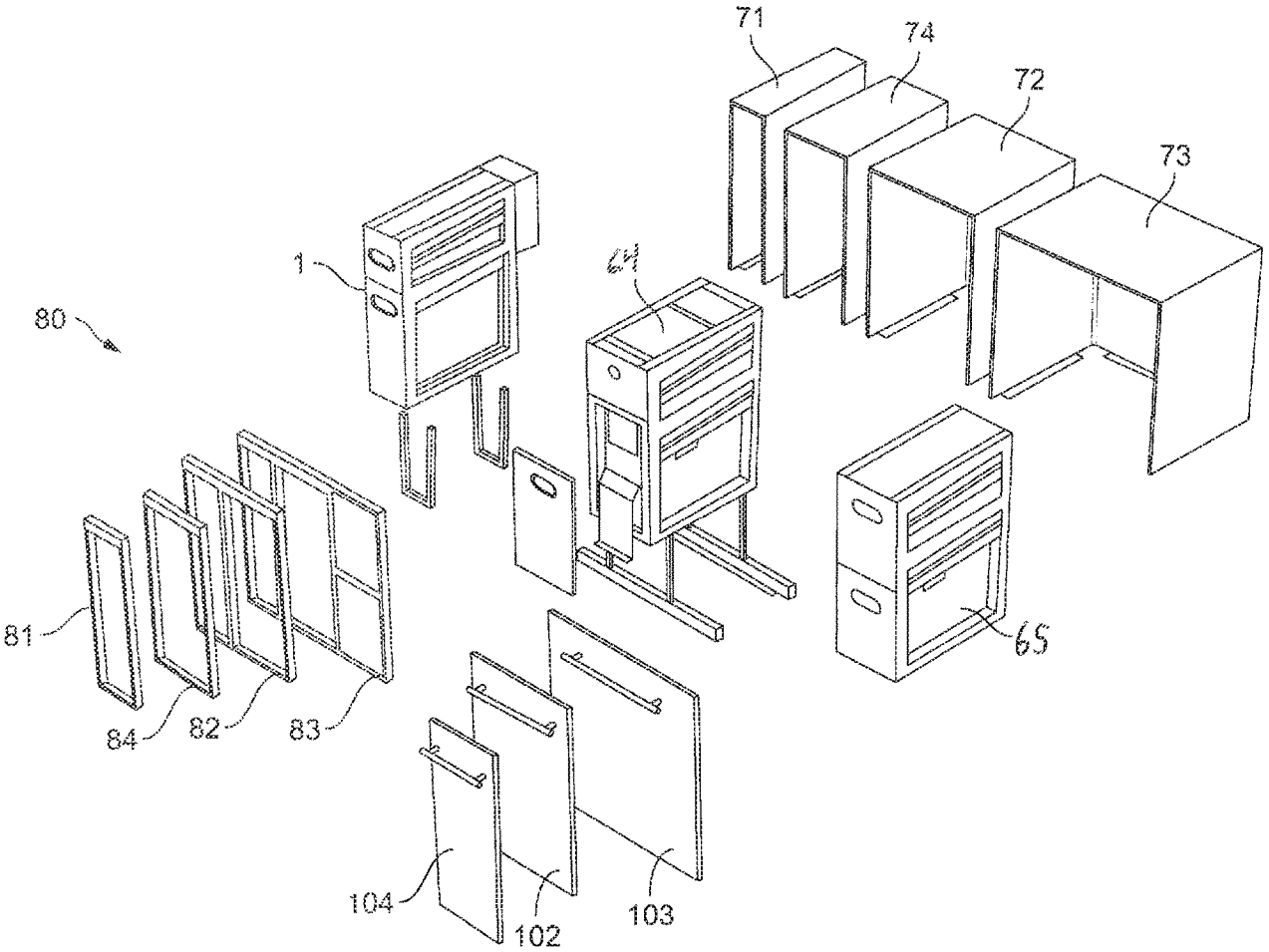
FIG. 8 shows an exploded isometric view of an appliance comprising three different modules for crushing, compacting and/or storing recyclable waste, including the can crushing and storing module of FIG. 1.

Referring to FIG. 8, a recycling appliance is indicated generally at 80.

The term "appliance" as used herein refers to one or more modules for crushing and/or compacting recyclable waste materials, such as cans, and/or storing compacted or non-compacted recyclable waste materials. Each module of the appliance performs one or more different functions.

The term "appliance assembly" as used herein refers to one or more modules for crushing and/or compacting recyclable waste materials, such as cans, and/or storing compacted or non-compacted recyclable waste materials. An appliance assembly may consist of any one of the modules or a combination of any two or more of the modules.

The appliances illustrated consist of modules selected from three different modules: a first, left-hand, can crushing and storing module 1; a second, centre, compacting and storing module 64 for paper, cardboard cartons or cardboard or plastics material containers; and, a third, right-hand, storage module 65, e.g. for glass.

The appliance may consist of:

The can crushing and storing module 1 in the casing 71 with bezel 81;

The compacting and storing module 64 for paper, cardboard cartons or cardboard or plastics material containers in the casing 74 with bezel 84 and drawer front 104;

The can crushing and storing module 1 with the compacting and storing module 64 for paper, cardboard cartons or cardboard or plastics material containers in the casing 72 with bezel 82 and drawer front 102; and/or The can crushing and storing module 1 with the compacting and storing module 64 for paper, cardboard cartons or cardboard or plastics material containers and the storage module 65, e.g. for glass, in the casing 73 with bezel 83 and drawer front 103.

Each module has its own chassis and where the first, can crushing and storing module 1 is combined with the second, compacting and storing module 64 for paper, cardboard cartons or cardboard or plastics material containers; or also with the storage module 65, e.g. for glass, the chassis of the first module 1 is fastened to the chassis of the second module 64 to form an integrated, two-module unit, or the chassis of the third module 65 is also fastened to the chassis of the second module 64 to form an integrated, three-module unit.

Throughout the description and claims of this specification, the words "comprise" and "contain" and variations of them mean "including but not limited to" and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of the features and/or steps are mutually exclusive. The invention is not restricted to any details of any foregoing embodiments. The invention extends to any novel one, or novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A can crushing and storing module comprising:

a) a chassis; and b) a crushing unit housed within the chassis and comprising:

i) a crushing unit drawer that is horizontally slidable into and out of the chassis;

ii) a can crushing device mounted in the crushing unit drawer and comprising an elongate crushing compartment that comprises a slot through which a crushed can may drop under gravity; and iii) a storing unit housed within the chassis and configured to receive a crushed can dropped through the slot;

wherein the crushing compartment has a non-circular cross-section and at least two walls, wherein one of the at least two walls forms at least a portion of a side wall of the crushing compartment, wherein at least one of the at least two walls is one of a generally planar moveable wall and a smoothly curved moveable wall that is moveable in a generally horizontal plane during a crushing operation thereby to reduce a size of the crushing compartment;

wherein the crushing unit further comprises a drive means for driving the moveable wall, wherein the drive means comprises an electrically powered sealed linear ram and a reciprocating drive rod operably connected to the moveable wall, and further wherein the drive means is connected to the moveable wall such that at least the drive rod of the drive means and the elongate crushing compartment are removable from the chassis as a single unit;

wherein the crushing compartment further comprises a first fixed end wall positioned opposite from the moveable wall, and further wherein the side wall is partially curved, such that the crushing compartment has the form of an open trough with an elongate curved bottom that extends from the moveable wall toward the fixed wall, wherein the side wall supports a can on the elongate curved bottom during a crushing operation, and wherein the can is crushed against the fixed wall and the crushed can dropped through the slot located at an end of the trough.

2. A module according to claim 1, wherein the slot is located adjacent to the first fixed end wall.

3. A module according to claim 1, wherein the moveable wall is moveable under the action of the linear ram so as to reduce the size of the crushing compartment.

4. A module according to claim 1, wherein the side wall is a continuous U-shaped side wall such that the crushing compartment is an open, generally U-shaped trough with a curved bottom.

5. A module according to claim 1, wherein the storing unit comprises a storing unit drawer which is slidable into and out of the chassis, wherein the crushing unit drawer is located above the storing unit drawer, and wherein a crushed can is deposited directly from the crushing unit into the storing unit.

6. A module according to claim 5, wherein the storing unit drawer comprises a container.

7. A module according to claim 6, wherein the container comprises a first arm, a second arm, and a third arm, wherein the first arm, the second arm, and the third arm extend from a rear face of a drawer front of the storing unit rearwardly in the direction of sliding of the storing unit drawer.

8. A module according to claim 7, wherein the first arm is in a perpendicular relationship with the second arm and the third arm.

9. A module according to claim 8, wherein the first arm, the second arm, and the third arm each comprise a C-shaped channel, and wherein the chassis comprises three runners that are each in a position corresponding to one of the first arm, the second arm, and the third arm.

10. A module according to claim 9, wherein the C-shaped channel of the first arm lies in a first plane at a bottom of the chassis, and the C-shaped channel of the second arm and the C-shaped channel of the third arm are in a second plane perpendicular to the C-shaped channel of the first arm.

11. A module according to claim 1, wherein the crushing unit comprises control electronics for the linear ram, wherein the control electronics include an initiation switch, and further wherein the initiation switch is operated by the crushing unit drawer when the crushing unit drawer reaches an in position.

12. A module according to claim 1, wherein the chassis is enclosed on all sides apart from one by a skin.

13. A module according to claim 1, wherein the chassis comprises a front, and wherein the crushing compartment is slidable out of the front of the chassis in a direction corresponding to its elongate dimension.

14. A module according to claim 1, wherein the crushing compartment is configured to be removable from the crushing unit drawer without damaging a component of the can crushing and storing module.

15. A module according to claim 1, wherein the drive means is connected to the moveable wall such that the sealed linear ram, the reciprocating drive rod, and the elongate crushing compartment are removable from the chassis as a single unit.

16. An appliance assembly, comprising:

a can crushing and storing module comprising:

a) a chassis;

b) a crushing unit housed within the chassis and comprising:

i) a crushing unit drawer that is horizontally slidable into and out of the chassis;

ii) a can crushing device mounted in the crushing unit drawer and comprising an elongate crushing compartment that comprises a slot through which a crushed can may drop under gravity; and iii) a storing unit housed within the chassis and configured to receive a crushed can dropped through the slot;

wherein the crushing compartment has a non-circular cross-section and at least two walls, wherein one of the at least two walls forms at least a portion of a side wall of the crushing compartment, wherein at least one of the at least two walls is one of a generally planar moveable wall and a smoothly curved moveable wall that is moveable in a generally horizontal plane during a crushing operation thereby to reduce a size of the crushing compartment;

wherein the crushing unit further comprises a drive means for driving the moveable wall, wherein the drive means comprises an electrically powered sealed linear ram and a reciprocating drive rod operably connected to the moveable wall, and further wherein the drive means is connected to the moveable wall such that at least the drive rod of the drive means and the elongate crushing compartment are removable from the chassis as a single unit;

wherein the crushing compartment further comprises a first fixed end wall positioned opposite from the moveable wall, and further wherein the side wall is partially curved, such that the crushing compartment has the form of an open trough with an elongate curved bottom that extends from the moveable wall toward the fixed wall, wherein the side wall supports a can on the elongate curved bottom during a crushing operation, and wherein the can is crushed against the fixed wall and the crushed can dropped through the slot located at an end of the trough; and a module that performs a different function than the can crushing and storing module.

17. An appliance assembly according to claim 16, further comprising a bezel that corresponds to the can crushing and storage module or the module that performs the different function than the can crushing and storing module.

18. A module according to claim 1, wherein the side wall is a single continuous side wall that fully supports the can during the crushing operation.

19. A module according to claim 2, wherein the crushing compartment further comprises a second fixed end wall, wherein the movable wall is positioned within the crushing compartment and movable by the drive means to crush a can between the first fixed end wall and the movable wall, wherein the reciprocating drive rod extends through the second fixed end wall, wherein the curved bottom of the crushing compartment extends from the second fixed end wall toward the first fixed end wall, and wherein the slot is positioned between the first fixed end wall and the curved bottom of the crushing compartment.

* * * * *